US006428278B1

(12) United States Patent
Montgomery et al.

(10) Patent No.: US 6,428,278 B1
(45) Date of Patent: Aug. 6, 2002

(54) MISTUNED ROTOR BLADE ARRAY FOR PASSIVE FLUTTER CONTROL

(75) Inventors: Matthew Montgomery, Jupiter; W. Kerry Byrne, North Palm Beach, both of FL (US); Rachel J. Block, Greer, SC (US); Peter D. Silkowski, Middletown; Sriram Srinivasan, Hebron, both of CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/729,046

(22) Filed: Dec. 4, 2000

(51) Int. Cl.[7] ..... F01D 5/14
(52) U.S. Cl. ..... 416/203; 416/228; 416/500
(58) Field of Search ..... 416/228, 234, 416/500, 203; 415/119

(56) References Cited

U.S. PATENT DOCUMENTS 4,097,192 A * 6/1978 Kulina ..... 416/175
4,878,810 A * 11/1989 Evans ..... 416/203
5,286,168 A 2/1994 Smith
5,667,361 A 9/1997 Yaeger et al.

* cited by examiner

*Primary Examiner*—Edward K. Look
*Assistant Examiner*—Ninh Nguyen
(74) *Attorney, Agent, or Firm*—Bachman & LaPointe, P.C.

(57) ABSTRACT

The present invention relates to an improved array of flow directing elements for incorporation in turbomachinery. In accordance with the present invention, an array of flow directing elements comprises a plurality of flow directing elements mounted to a rotor disk. The plurality of flow directing elements includes a first set of first flow directing elements whose natural vibration frequency has been modified by having material removed from a leading edge tip region and a second set of second flow directing elements whose natural vibration frequency has been modified by having material removed from a midspan leading edge region. The array may further comprise unmodified flow directing elements arranged with the modified flow directing elements.

12 Claims, 2 Drawing Sheets

MISTUNED ROTOR BLADE ARRAY FOR PASSIVE FLUTTER CONTROL

BACKGROUND OF THE INVENTION

The present invention relates to an array of flow directing elements for turbomachinery, in particular to an improved rotor blade array having improved flutter resistance due to structural mistuning.

Turbomachinery devices, such as gas turbine engines and steam turbines, operate by exchanging energy with a working fluid using alternating rows of rotating blades and non-rotating vanes. Each blade and vane has an airfoil portion that interacts with the working fluid.

Airfoils have natural vibration modes of increasing frequency and complexity of the mode shape. The simplest and lowest frequency modes are typically referred to as first bending, second bending, and first torsion. First bending is a motion normal to the flat surface of an airfoil in which the entire span of the airfoil moves in the same direction. Second bending is similar to first bending, but with a change in the sense of the motion somewhere along the span of the airfoil, so that the upper and lower portions of the airfoil move in opposite directions. First torsion is a twisting motion around an elastic axis, which is parallel to the span of the airfoil, in which the entire span of the airfoil, on each side of the elastic axis, moves in the same direction.

It is known that turbomachinery blades are subject to destructive vibrations due to unsteady interaction of the blades with the working fluid. One type of vibration is known as flutter, which is an aero-elastic instability resulting from the interaction of the flow over the blades and the blades' natural vibration tendencies. The lowest frequency vibration modes, first bending and first torsion, are typically the vibration modes that are susceptible to flutter. When flutter occurs, the unsteady aerodynamic forces on the blade, due to its vibration, add energy to the vibration, causing the vibration amplitude to increase. The vibration amplitude can become large enough to cause structural failure of the blade. The operable range, in terms of pressure rise and flow rate, of turbomachinery is restricted by various flutter phenomena.

It is also known that the blades' susceptibility to flutter is increased if all blades on a disk are identical in terms of their vibration frequencies. Advances in manufacturing techniques have resulted in the production of blades that have nearly uniform properties. This uniformity is desirable to ensure consistent aerodynamic performance, but undesirable in that it increases susceptibility to flutter. Therefore, it has become desirable to introduce intentional variation in the blades during the manufacturing process to achieve flutter resistance. These variations should significantly affect the vibration characteristics of the blade, thus introducing structural mistuning, without compromising aerodynamic performance or introducing undue complexity to the manufacturing process.

The use of nonuniformity in vibration frequency to avoid flutter instability for a row of attached blades is addressed in U.S. Pat. No. 5,286,168 to Smith. The approach discussed in this patent uses frequency nonuniformity for flutter avoidance, but requires the manufacture of two distinct blade types.

The use of nonuniformity in shroud angle to avoid flutter instability for a blade row of attached, shrouded blades is addressed in U.S. Pat. No. 5,667,361 to Yaeger et al. This approach is unattractive for modern gas turbine engines since the use of shrouds imposes an aerodynamic performance penalty.

SUMMARY OF THE INVENTION

Accordingly, it is an object of the present invention to provide an improved array of flow directing elements for use in turbomachinery, which array provides passive flutter control.

It is a further object of the present invention to provide an improved array as above which does not require two distinct types of flow directing elements.

The foregoing objects are attained by the improved array of the present invention.

In accordance with the present invention, an array of flow directing elements for use in turbomachinery for providing passive flutter control is provided. The array broadly comprises a plurality of flow directing elements mounted to a rotor disk with said plurality of flow directing elements comprising a first set of first flow directing elements whose natural vibration frequency has been modified by having material removed from a leading edge tip region and a second set of second flow directing elements whose natural vibration frequency has been modified by having material removed from a midspan leading edge region.

Other details of the structurally mistuned array of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

The intent of the present invention is passive flutter control by constructing an array of flow directing elements from structurally mistuned elements or blades with different natural vibration frequencies. The structural mistuning could be accomplished by manufacturing flow directing elements or blades with different geometric parameters that include, but are not limited to, blade thickness, chord length, camber, and profile shape. Since the manufacture of multiple flow directing element or blade types is undesirable, structural mistuning can be accomplished by manufacturing a single flow directing element or blade type and machining features into the flow directing element or blade that alter the natural vibration frequencies of the flow directing elements or blades. Such features include, but are not limited to, chord blending, as shown in FIGS. 1*a* and 1*b*, or squealer cuts along the tip of the flow directing element or blade.

Constructing an array such that the natural vibration frequency of each flow directing element or blade differs from that of immediately adjacent flow directing elements or blades increases the flutter resistance of the flow directing elements or blades. The frequency separation criterion is that adjacent flow directing elements or blades differ by at least 1.0% of the average frequency. The foregoing separation criterion is imposed on each of the structural modes that pose a flutter threat, typically first bending and first torsion. The different structural modes of the different flow directing elements or blades also preferably have separate frequencies, e.g. the first bending frequency of a high frequency flow directing element or blade should differ from the first torsion frequency of a low frequency flow directing element or blade by at least 1.0%.

Figure 1A:
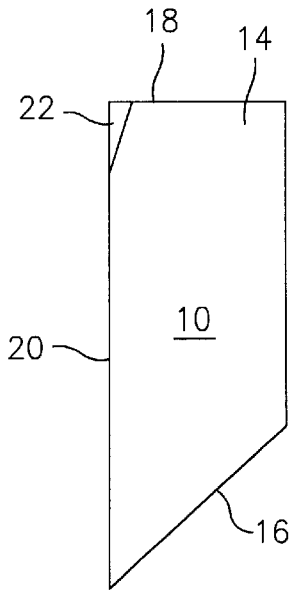
FIGS. 1*a* and 1*b* are side views of flow directing elements to be used in the array of the present invention.
Figure 1B:
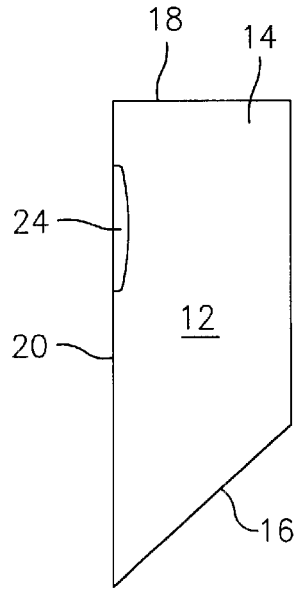

Referring now to FIGS. 1*a* and 1*b*, two flow directing elements or blades 10 and 12 are shown. Each flow directing element or blade 10 and 12 has an airfoil portion 14, a hub surface 16, a tip surface 18, and a leading edge 20. Flow directing element or blade 10 has a higher first torsion frequency due to material being removed from the region 22 bordering the tip surface 18 and the leading edge 20. Flow directing element or blade 12 has lower first torsion frequency due to material being removed from the mid-span, leading edge region 24. The material may be removed from the regions 22 and 24 using any suitable technique known in the art. Other than having material removed from respective regions 22 and 24, the flow directing elements or blades 10 and 12 are of the same type.

The amount of material removed from the regions 22 and 24 should be such that (1) the difference in first torsion frequency between an unmodified flow directing element or blade and each of the flow directing elements or blades 10 and 12 exceeds 1.0% of the average first torsion frequency; and (2) the difference in first bending frequency between an unmodified flow directing element or blade and each of the flow directing elements or blades 10 and 12 exceed 1.0% of the average first bending frequency.

Figure 2:
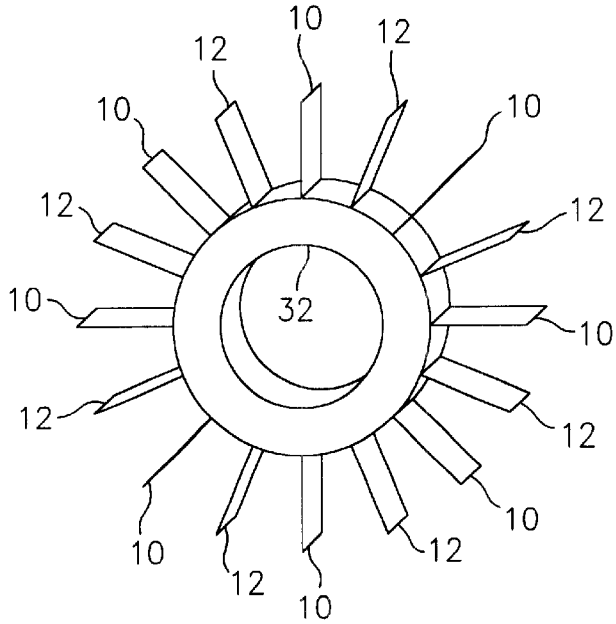
FIG. 2 is a perspective view of a first embodiment of an array of flow directing elements in accordance with the present invention.

FIG. 2 illustrates one embodiment of an array of flow directing elements to be incorporated into turbomachinery device such as a gas turbine engine or a steam turbine. Such devices typically having a plurality of rows of flow directing elements, such as rotor blades, which are alternated with rows of stationary vanes or blades. The combination of a rotor row and vane row being known as a stage. In the embodiment of FIG. 2, the flow directing elements are aligned in a row of alternating high and low frequency flow directing elements or blades 10 and 12. As can be seen from this figure, the flow directing elements or blades 10 and 12 are attached to a disk 32. The disk 32 may comprise any suitable rotor disk known in the art. Further, the blades 10 and 12 may be attached to the disk 32 using any suitable means known in the art.

Figure 3:
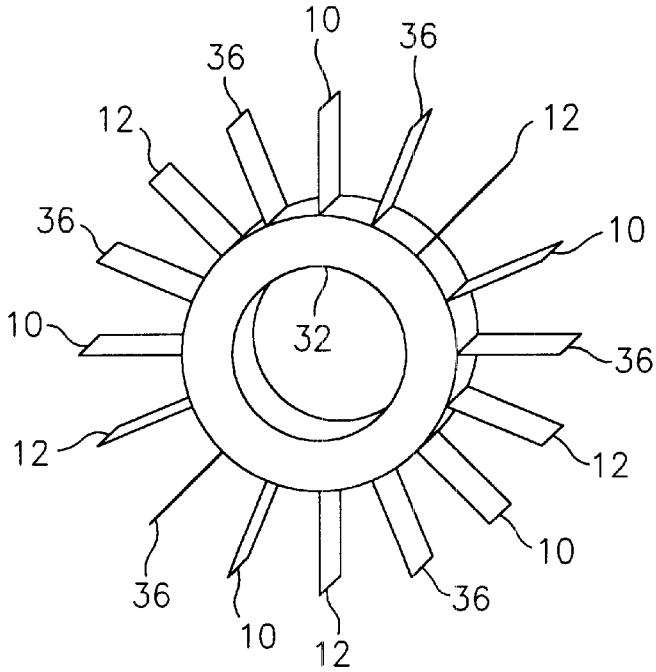
FIG. 3 is a perspective view of an alternative embodiment of an array of flow directing elements in accordance with the present invention.

FIG. 3 illustrates an alternative embodiment of an array of flow directing elements to be incorporated into a turbomachinery device. As shown in this figure, the flow directing elements or blades are aligned in a row and include alternating high frequency flow directing elements 10, unmodified flow directing elements 36, and low frequency flow directing elements 12 attached to a disk 32. As before, the disk 32 may comprise any suitable rotor disk known in the art. The flow directing elements or blades 10, 12, and 36 may be attached to the disk using any suitable means known in the art.

Figure 4:
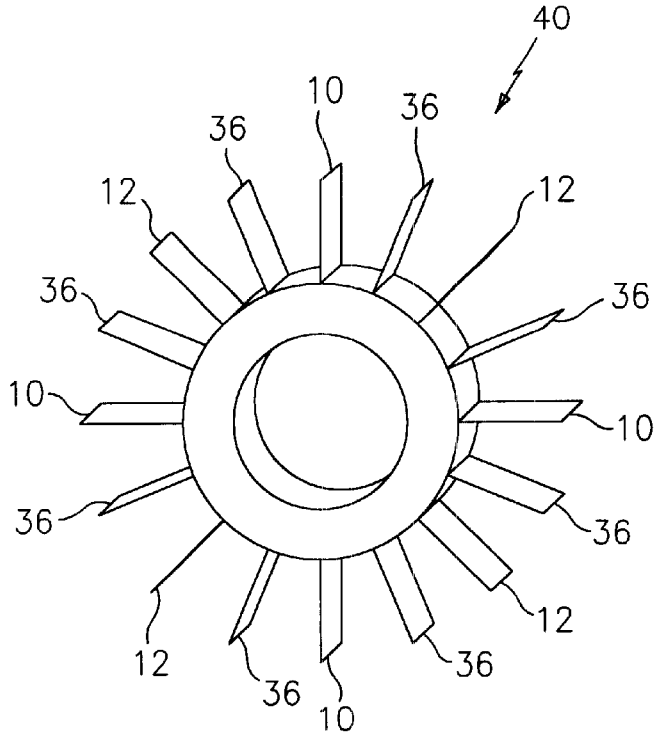
FIG. 4 is a perspective view of yet another alternative embodiment of an array of flow directing elements in accordance with the present invention.

FIG. 4 illustrates still another embodiment of an array of flow directing elements to be incorporated into a turbomachinery device. The array 40 has a plurality of flow directing elements or blades in the following sequence: a high frequency flow directing element or blade 10, an unmodified flow directing element or blade 36, a low frequency flow directing element or blade 12, and an unmodified flow directing element or blade 36. The flow directing elements or blades 10, 36, and 12 are arrayed in a circular pattern. The flow directing elements or blades 10, 36 and 12 are mounted to a disk 32. The disk 32 may comprise any suitable rotor disk known in the art. The blades 10, 36, and 12 may be attached to the disk 32 using any suitable means known in the art.

As previously discussed, the various embodiments of the flow directing elements array of the present invention may be used in a wide variety of turbomachinery to provide passive flutter control.

It is apparent that there has been provided in accordance with the present invention a mistuned rotor blade array for passive flutter control which fully satisfies the means, objects, and advantages set forth hereinbefore. While the present invention has been described in the context of specific embodiments thereof, other alternatives, modifications, and variations, will become apparent to those skilled in the art have read the foregoing description. Therefore, it is intended to embrace those alternatives, modifications, and variations which fall within the broad scope of the appended claims.

What is claimed is:

1. An array of flow directing elements for use in turbomachinery comprising:

a plurality of flow directing elements mounted to a rotor disk;

said plurality of flow directing elements comprising a first set of first flow directing elements whose natural vibration frequency has been modified by having material removed from a leading edge tip region; and said plurality of flow directing elements further comprising a second set of second flow directing elements whose natural vibration frequency has been modified by having material removed from a leading edge region substantially at a midspan point of the flow directing surface.

2. An array according to claim 1, wherein each of said first flow directing elements and each of said second flow directing elements are identical except for said regions where said materials has been removed.

3. An array of flow directing elements for use in turbomachinery comprising:

a plurality of flow directing elements mounted to a rotor disk;

said plurality of flow directing elements comprising a first set of first flow directing elements whose natural vibration frequency has been modified by having material removed from a leading edge tip region;

said plurality of flow directing elements further comprising a second set of second flow directing elements whose natural vibration frequency has been modified by having material removed from a midspan leading edge region; and said first set of flow directing elements having frequencies of first bending, first torsion, and second bending vibration modes different from the first bending, first torsion, and second bending vibration mode frequencies of said second flow directing elements.

4. An array according to claim 3, further comprising said first and second sets of flow directing elements being arranged in an alternating pattern so that adjacent flow directing elements do not have the same vibration frequency.

5. An array according to claim 3, wherein said first and second flow directing elements are aligned in a row.

6. An array according to claim 3, wherein said array comprises a rotor blade assembly for an engine.

7. An array of flow directing elements for use in turbomachinery comprising:

a plurality of flow directing elements mounted to a rotor disk;

said plurality of flow directing elements comprising a first set of first flow directing elements whose natural vibration frequency has been modified by having material removed from a leading edge tip region;

said plurality of flow directing elements further comprising a second set of second flow directing elements whose natural vibration frequency has been modified by having material removed from a midspan leading edge region; and third unmodified flow directing elements.

8. An array according to claim 7, wherein said flow directing elements are arranged in an alternating pattern of one of said first flow directing elements, one of said unmodified flow directing elements, and one of said second flow directing elements so that no adjacent flow directing elements have the same vibration frequency.

9. An array according to claim 7, wherein said flow directing elements are arranged in sequences of one of said first flow directing elements, one of said unmodified flow directing elements, one of said second flow directing elements, and one of said unmodified flow directing elements.

10. An array according to claim 7, wherein sufficient material is removed from each said first flow directing element so that the difference in first torsion frequency between an unmodified flow directing element and said first flow directing element exceeds 1.0% of the average first torsion frequency for the unmodified flow directing element.

11. An array according to claim 7, wherein sufficient material is removed from said second flow directing elements such that the difference in first torsion frequency between said unmodified flow directing element and said second flow directing element exceeds 1.0% of the average first torsion frequency of an unmodified flow directing element.

12. An array according to claim 7, wherein said first, second, and third flow directing elements are aligned in a row.

* * * * *

UNITED STATES PATENT AND TRADEMARK OFFICE
Certificate

Patent No. 6,428,278 B1 Patented: August 6, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Matthew Montgomery, Jupiter, FL (US); W. Kerry Byrne, North Palm Beach, FL (US); Rachel J. Block, Greer, SC (US); Peter D. Silkowski, Middletown, CT (US); Sriram Srinivasan, Hebron, CT (US); and John Orosa, Palm Beach Gardens, FL (US).

Signed and Sealed this First Day of July 2014.

EDWARD LOOK
*Supervisory Patent Examiner*
Art Unit 3745
Technology Center 3700